US010199753B2

(12) United States Patent
Flaherty, IV

(10) Patent No.: US 10,199,753 B2
(45) Date of Patent: Feb. 5, 2019

(54) MULTI-PIN CONNECTOR BLOCK ASSEMBLY

(71) Applicant: Corning Optical Communications RF LLC, Glendale, AZ (US)

(72) Inventor: Thomas Edmond Flaherty, IV, Surprise, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 15/581,913

(22) Filed: Apr. 28, 2017

(65) Prior Publication Data

US 2018/0316103 A1 Nov. 1, 2018

(51) Int. Cl.

| | |
|---|---|
| ***H01R 13/64*** | (2006.01) |
| ***H01R 9/26*** | (2006.01) |
| ***H01R 12/71*** | (2011.01) |
| ***H01R 12/91*** | (2011.01) |
| ***H01R 13/646*** | (2011.01) |

(52) U.S. Cl.
CPC ..... *H01R 9/26* (2013.01); *H01R 9/2691* (2013.01); *H01R 12/714* (2013.01); *H01R 12/91* (2013.01); *H01R 13/646* (2013.01)

(58) Field of Classification Search
CPC ..... H01R 13/6315; H01R 12/91; H01R 13/28
USPC ..... 439/246, 247, 248
See application file for complete search history.

(56) References Cited

U.S. PATENT DOCUMENTS 4,968,263 A * 11/1990 Silbernagel ..... H01R 13/6315 439/246
5,112,235 A * 5/1992 Enomoto ..... H01R 12/712 439/246
5,201,670 A * 4/1993 Watanabe ..... H01R 13/62933 439/372
5,213,533 A * 5/1993 Walden ..... H01R 13/629 439/358
5,306,169 A * 4/1994 Fukushima ..... H01R 12/712 439/248
5,769,652 A * 6/1998 Wider ..... H01R 13/6315 439/248

(Continued)

FOREIGN PATENT DOCUMENTS

EP 2211228 A2 7/2010

OTHER PUBLICATIONS

International Search Report and Written Opinion PCT/US2018/027985 dated Jun. 20, 2018.

*Primary Examiner* — Abdullah Riyami
*Assistant Examiner* — Thang Nguyen
(74) *Attorney, Agent, or Firm* — Tamika A. Crawl-Bey

(57) ABSTRACT

A radio frequency (RF) connector block assembly having a plurality of connector pin assemblies mounted within a multi-connector block is disclosed. Each connector pin assembly has a dielectric and a contact pin positioned in a housing. Multiple housings may be independently removably mounted in the multi-connector block with independently movable contact pins. A first end of each contact pin is adapted to provide electrical continuity with an external component, for example, a connector, and a second end of each contact pin terminates distally in a connection feature, which may be connected to an external structure, for example, a printed circuit board (PCB). Each contact pin moves axially in response to movement of the connection feature by engagement with the PCB.

19 Claims, 15 Drawing Sheets

(56) References Cited

U.S. PATENT DOCUMENTS

| | | | | | |
|---|---|---|---|---|---|
| 5,850,693 | A * | 12/1998 | Guran | H01R 43/205 | 29/884 |
| 5,919,055 | A * | 7/1999 | Hattori | H01R 13/62938 | 439/310 |
| 6,716,065 | B1 * | 4/2004 | Brooks | H01H 85/205 | 439/620.27 |
| 7,037,131 | B1 * | 5/2006 | Chen | H01R 13/6215 | 439/362 |
| 7,083,462 | B1 * | 8/2006 | Chen | H01R 13/62966 | 439/362 |
| 7,207,811 | B2 * | 4/2007 | Xu | H01R 12/57 | 439/83 |
| 8,162,674 | B2 * | 4/2012 | Cho | H01R 12/73 | 362/613 |
| 9,397,432 | B2 * | 7/2016 | Yukutake | H01R 13/46 | |
| 9,762,002 | B1 * | 9/2017 | Matsumoto | H01R 13/6271 | |
| 2002/0031924 | A1 * | 3/2002 | Davis | H01R 9/2491 | 439/76.2 |
| 2005/0136755 | A1 | 6/2005 | Xu | | |
| 2015/0295354 | A1 * | 10/2015 | Morello | H01R 13/639 | 439/352 |

* cited by examiner

MULTI-PIN CONNECTOR BLOCK ASSEMBLY

CROSS-REFERENCE TO RELATED APPLICATIONS

This application is related to U.S. application Ser. No. 15/581,891, filed concurrently on Apr. 28, 2017 and entitled "Radio Frequency (RF) Connector Pin Assembly," which is incorporated herein by reference in its entirety.

FIELD

The disclosure relates generally to a multi-pin connector block assembly and particularly to multi-pin connector block assemblies having multiple RF connector pin assemblies each with a floating contact pin (also referred to as a "connector pin") mounted in a housing disposed therein for connection to a printed circuit board.

BACKGROUND

Within the technical field of microwave frequency connectors there exist male contact pins designed to solder onto printed circuit boards (PCBs). These contact pins are metallic and are generally surrounded by a plastic insulator and a metallic housing providing a connector pin assembly. The connector pin assemblies can be coupled by various methods including a push-on design. The contact pins are a key component in the transmission of the electrical signal. There are instances where, due to tolerance stack and PCBs that are not flat, the connector needs to overcome large variable distances and still maintain good performance at high frequencies. Accordingly, efforts have been focused on developing connector pin assemblies incorporating so-called "floating" contact pins, which axially move bidirectionally to accommodate the non-uniformity of a PCB's surface flatness. However, the axial movement of the contact pins has to be restrained in both directions to allow the contact pin to be retained in the carrier or header; and to work, the restraints must be diametrically larger than the inside diameter of a passage in the carrier or header. The difficulty in assembly of the connector pin assembly involves inserting a contact pin with two restraints through a passage when the restraints are larger than the passage, and doing so without damaging the carrier or header. This is especially difficult with connector pin assemblies incorporating multiple contact pins.

Referring to FIGS. 1 and 2, a conventional floating pin assembly 100 is illustrated. A single pin arrangement is shown in FIG. 1, and a multi-pin arrangement is shown in FIG. 2. In FIGS. 1 and 2, each pin 102 is shown installed through a hole 104 in a carrier 106. The pin 102 is typically manufactured of an electrically conductive material, for example a metal, while the carrier 106 is typically manufactured of a dielectric material such that the carrier 106 may act as an insulator to the pin 102. The carrier 106 may also be referred to as a header. To allow the pin 102 to "float", the pin 102 has a shaft 108 with a smaller outside diameter than an inside diameter of the hole 104. In this way, the shaft 108 may freely slide in the hole 104, thereby allowing the pin 102 to axially move. However, it is necessary to limit the amount of bidirectional axial movement of the pin 102 to maintain the pin 102 within the carrier 106. To provide such bidirectional limitation, the pin 102 has two integral restraints, a first restraint 110, to limit the axial movement of the pin 102 in a first direction, and a second restraint 112 to limit the axial movement of the pin 102 in a second direction.

The first restraint 110 and the second restraint 112 extend radially outwardly from the surface of the shaft 108. However, to be able to limit the axial movement of the pin 102, both the first restraint 110 and the second restraint 112 must extend radially outwardly from the shaft 108 to a circumferential periphery beyond the outside diameter of the hole 104. Typically, both the first restraint 110 and the second restraint 112 are formed monolithically with and as part of the pin 102. Because of the requisite size and the monolithic construction of the pin 102, one of the first restraint 110 or second restraint 112 must be inserted in the carrier 106 by forcing it through the hole 104 during assembly of the floating pin assembly 100. Accordingly, one or both of the first restraint 110 and second restraint 112 may have a rounded or angled edge or surface to facilitate such insertion. As can be seen in FIGS. 1 and 2, the first restraint 110 has an angled surface 114, indicating that the pin 102 was inserted in the carrier 106 by forcing the first restraint 110 through the hole 104. While the angled surface 114 may facilitate installation of the pin 102 to a certain extent, such installation puts stress on the material of the carrier 106, which may result in cracks or some other structural impairment physically compromising the carrier 106 and/or compromising its insulating integrity. Additionally, the angled surface 114 allows the pin 102 to be installed in one direction only.

The chance of such structural impact and the compromising effects are compounded with multi-pin arrangements as illustrated in FIG. 2. Five pins 102 are shown in FIG. 2, and each may have been installed by forcing the respective first restraint 110 through the respective hole 104 in the carrier 106. Although the pin 102 may axially move bidirectionally in the hole 104, such movement only occurs between the first restraint 110 and the second restraint 112. As such, once installed, the pin 102 may not be removed either by continuing to force the pin 102 in the same direction as installed, or by forcing it back through the hole 104. Accordingly, once one of the pins 102 is installed in the carrier 106, it cannot be removed without damaging the carrier 106.

In FIG. 2, the second restraints 112 are shown engaging with a printed circuit board (PCB) 116. In this regard, the second restraint 112 on each pin 102 is also used as a contact head to be connected to the PCB 116, and may be soldered to a conductive trace (not shown in FIG. 2) on the PCB 116. The PCB 116 may not be perfectly flat or planar but may have surface non-uniformities, such as, for example, a bow, as is illustrated in FIG. 2 with regard to the PCB 116. As the different second restraints 112 engage the PCB 116, the non-uniformity in the surface of the PCB 116 causes the second restraints 112 to move, which axially moves the pins 102, allowing the pins 102 to "float". However, because the second restraints 112 are also used as contact heads, the non-uniformity of the PCB 116 may cause the second restraints 112 to be forced against the carrier 106. This is shown in FIG. 2 by the pin 102 installed in the middle. Not only may this installation add to the possibility of damage to the carrier 106, but it may also compromise the integrity of the connection of the second restraint 112 to the conductive trace on the PCB 116.

Consequently, there is an unresolved need for a radio frequency (RF) connector pin assembly that not only provides a pin that moves axially, or floats, to accommodate the non-uniformity of a PCB surface, but can also be installed without compromising a carrier or header, or the connection to the PCB.

No admission is made that any reference cited herein constitutes prior art. Applicant expressly reserves the right to challenge the accuracy and pertinence of any cited documents.

SUMMARY

One embodiment of the disclosure relates to a radio frequency (RF) connector block assembly. The RF connector block assembly comprises a multi-connector block comprising a plurality of housing ports, wherein the multi-connector block is attachable to an external structure. The RF connector block assembly also comprises a plurality of housings, wherein each housing of the plurality of housings is removably mounted in a housing port of the plurality of housing ports, and wherein a housing of the plurality of housings is independently removably mounted from another housing of the plurality of housings. The RF connector block assembly also comprises a contact pin movably disposed in each housing of the plurality of housings, wherein the contact pin in one housing of the plurality of housings is independently axially movable in a first direction and a second direction from the contact pin in another housing of the plurality of housings.

Another embodiment of the disclosure relates to a RF connector block assembly. The RF connector block assembly comprises a connector block comprising at least one housing port, wherein the connector block is attachable to an external structure. The RF connector block assembly also comprises at least one housing removably mounted in the at least one housing port. The RF connector block assembly also comprises at least one contact pin movably disposed in the at least one housing, wherein the at least one contact pin in the at least one housing is movable in a first direction and a second direction.

Another embodiment of the disclosure relates to an RF connector pin assembly. The RF connector pin assembly comprises a first dielectric comprising a first stop surface and a first through-passage extended through the first dielectric. The RF connector pin assembly also comprises a second dielectric comprising a second stop surface positioned opposite the first stop surface, and a second through-passage extended through the second dielectric, wherein the second through-passage is aligned with the first through-passage, and wherein the first stop surface and the second stop surface define a gap between the first dielectric and the second dielectric. The RF connector pin assembly also comprises a contact pin comprising a first pin section, a second pin section, and an annular collar at a juncture of the first pin section and the second pin section. The first pin section is movably disposed in the first through-passage and the second pin section is movably disposed in the second through-passage. The annular collar is located in the gap. Axial movement of the contact pin is limited to movement of the annular collar in the gap between the first stop surface and the second stop surface. The first pin section is adapted to provide electrical continuity with an external component and the second pin section terminates distally in a connection feature.

Another embodiment of the disclosure relates to an RF connector pin assembly. The RF connector pin assembly comprises a housing comprising a first segment and a second segment separated from the first segment by a partition. The partition comprises an access opening extended between the first segment and the second segment. The RF connector pin assembly also comprises a first dielectric positioned in the second segment. The first dielectric comprises a first stop service and a first through-passage extended through the first dielectric, wherein the first through-passage is aligned with the access opening. The RF connector pin assembly also comprises a second dielectric positioned in the second segment. The second dielectric comprises a second stop surface positioned opposite the first stop surface and a second through-passage extended through the second dielectric. The second through-passage is aligned with the first through-passage and with the access opening, and the first stop surface and the second stop surface define a gap between the first dielectric and the second dielectric. The first stop surface is spaced a distance "A" from the second stop surface by the gap. The RF connector pin assembly also comprises a contact pin comprising a first pin section, a second pin section, and an annular collar at a juncture of the first pin section and the second pin section. The first pin section is movably disposed in the first through-passage and the second pin section is movably disposed in the second through-passage. The contact pin is axially movable in a first direction and a second direction in the first through-passage and the second through-passage and the annular collar is located in the gap. Axial movement of the contact pin is limited to movement of the annular collar in the gap in the first direction by the first stop surface and in the second direction by the second stop surface. The first pin section is extended through the first through-passage and through the access opening into the first segment and the second pin section is distally terminated in a connection feature.

Another embodiment of the disclosure relates to an RF connector pin assembly. The RF connector pin assembly comprises a housing comprising a first segment and a second segment separated from the first segment by a partition. The partition comprises an access opening extended between the first segment and the second segment. The RF connector pin assembly further comprises a dielectric positioned in the second segment. The dielectric comprises a through-passage extended through the dielectric between a first face and a second face, and wherein the through-passage comprises an inside diameter "$TP_{ID}$" and is aligned with the access opening. The RF connector pin assembly further comprises a contact pin comprising a shaft having a first end and a second end. The shaft is movably friction-fit in the through-passage, and the first end of the shaft is extended from the first face of the through-passage and through the access opening into the first segment. The second end of the shaft is extended from the second face of the through-passage and is terminated in a connection feature. The shaft has an outside diameter "$S_{OD}$" that is larger than the inside diameter "$TP_{ID}$" of the through-passage. The contact pin is axially movable in a first direction and a second direction in the through-passage when the outside diameter "$S_{OD}$" of the shaft is in contact with the inside diameter "$TP_{ID}$" of the through-passage.

Yet another embodiment of the disclosure relates to a method for assembling an RF connector pin assembly. The method comprises providing a housing comprising a first segment, a second segment, and a partition separating the first segment from the second segment. The method also comprises inserting a first dielectric in the second segment of the housing, the first dielectric comprising a first through-passage and a first stop surface. The method also comprises inserting a second dielectric in the second segment of the housing, the second dielectric comprising a second through-passage and a second stop surface, wherein the second through-passage is aligned with the first through-passage and wherein the first stop surface and the second stop surface form a gap. The method also comprises movably disposing a contact pin in the housing, the contact pin comprising a first pin section, a second pin section, and an annular collar at a juncture of the first pin section and the second pin section. The first pin section is movably disposed in the first through-passage and the second pin section is movably disposed in the second through-passage. The contact pin is axially movable in a first direction and a second direction in the first through-passage and the second through-passage. The annular collar locates in the gap other than by passing through the first through-passage and the second through-passage.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

One embodiment of the disclosure relates to a radio frequency (RF) connector pin assembly. The RF connector pin assembly comprises a first dielectric comprising a first stop surface and a first through-passage extended through the first dielectric. The RF connector pin assembly also comprises a second dielectric comprising a second stop surface positioned opposite the first stop surface, and a second through-passage extended through the second dielectric, wherein the second through-passage is aligned with the first through-passage, and wherein the first stop surface and the second stop surface define a gap between the first dielectric and the second dielectric. The RF connector pin assembly also comprises a contact pin comprising a first pin section, a second pin section, and an annular collar at a juncture of the first pin section and the second pin section. The first pin section is movably disposed in the first through-passage and the second pin section is movably disposed in the second through-passage. The annular collar is located in the gap. Axial movement of the contact pin is limited to movement of the annular collar in the gap between the first stop surface and the second stop surface. The first pin section is adapted to provide electrical continuity with an external component and the second pin section terminates distally in a connection feature.

Figure 1:
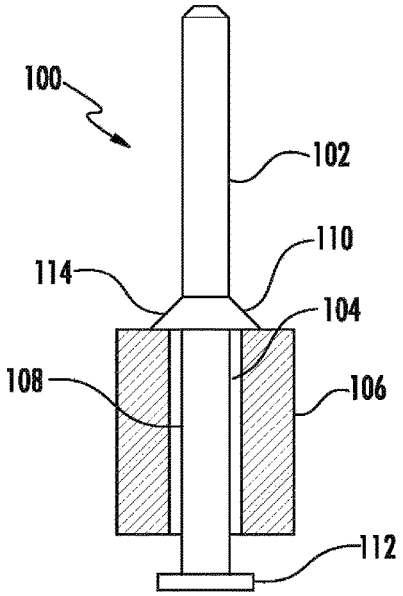
FIG. 1 PRIOR ART
FIG. 1 is a partial cross-sectional view of a conventional floating pin.
Figure 2:
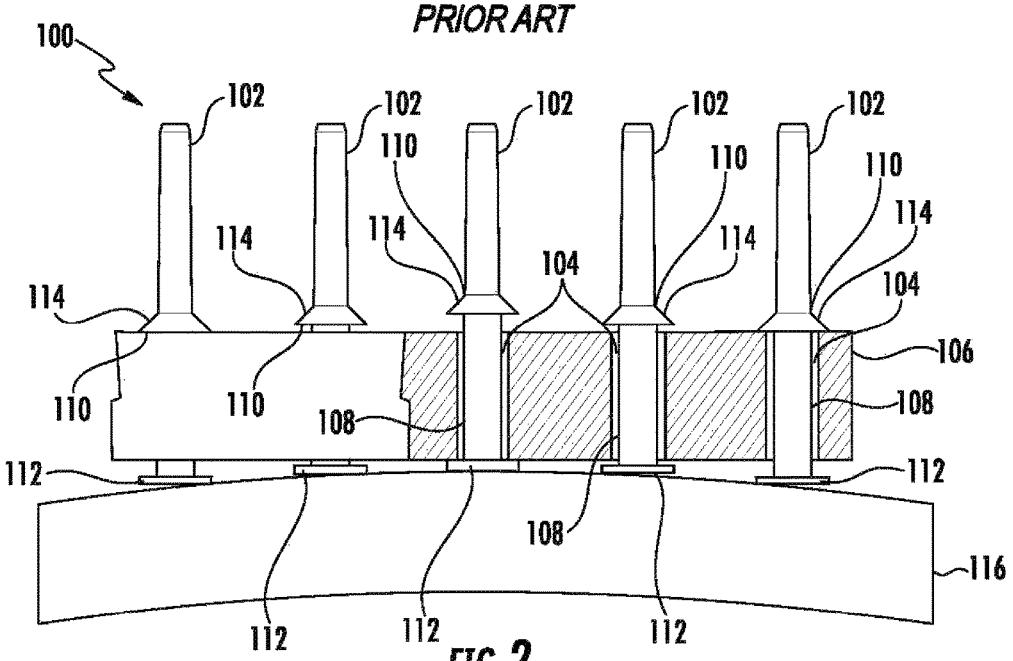
FIG. 2 PRIOR ART
FIG. 2 is a partial cross-sectional view of multiple conventional floating pins engaging a printed circuit board (PCB)
Figure 3:
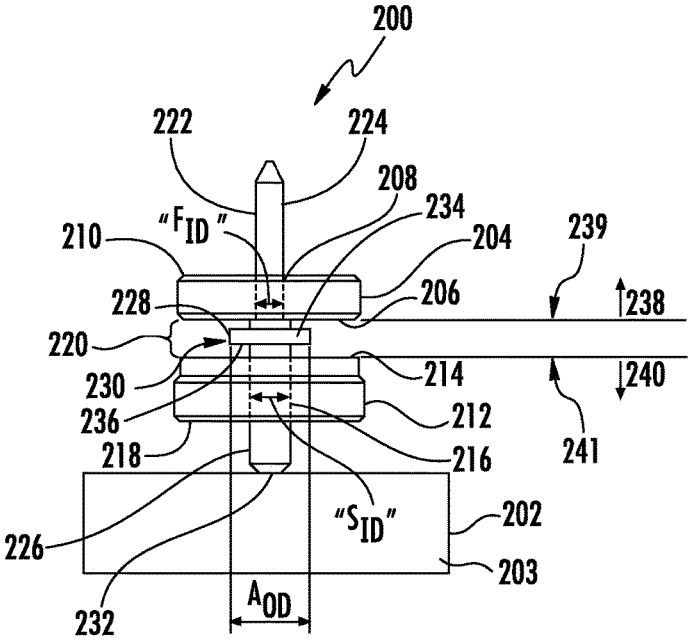
FIG. 3 is a partial detailed view of an exemplary embodiment of a single pin arrangement of a radio frequency (RF) connector pin assembly, having a connector pin and dielectrics.
Figure 4:
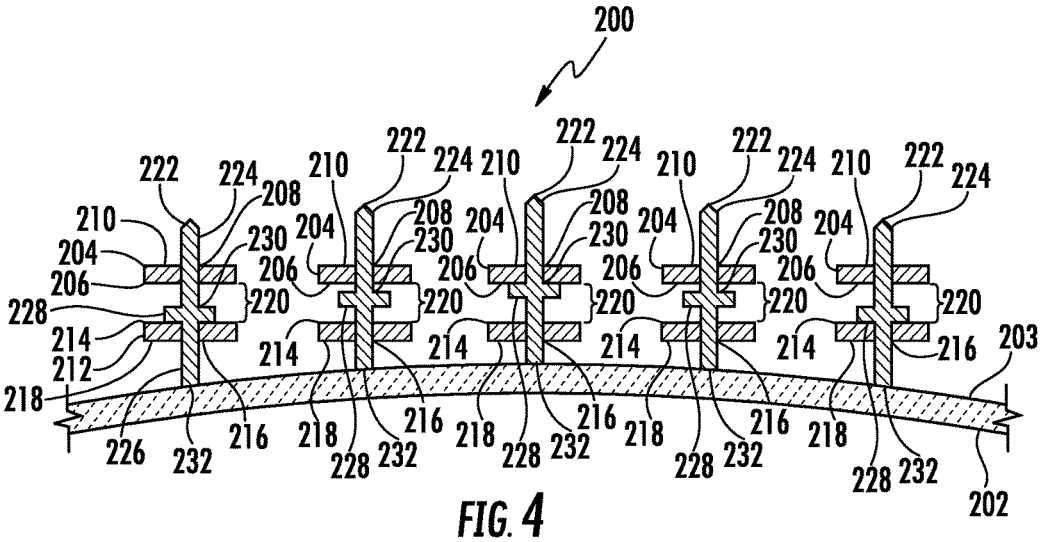
FIG. 4 is a partial cross-sectional view of a multi-pin arrangement of the RF connector pin assembly of FIG. 3 engaging a PCB.

In this regard, FIGS. 3 and 4 illustrate an exemplary RF connector pin assembly 200 engaged with an external structure 202, which may be a printed circuit board (PCB). In FIGS. 3 and 4, the RF connector pin assembly 200 is not shown with any housing or other enclosure to facilitate the discussion of certain components of the RF connector pin assembly 200. In FIG. 3, the RF connector pin assembly 200 is illustrated with a single pin arrangement, while in FIG. 4, a multi-pin arrangement is illustrated. The RF connector pin assembly 200 has a first dielectric 204 with a first stop surface 206. A first through-passage 208, shown in dotted lines in FIG. 3, extends through the first dielectric 204 from and through the first stop surface 206 to and through an upper face 210. A second dielectric 212 has a second stop surface 214 positioned opposite the first stop surface 206. A second through-passage 216, shown in dotted lines in FIG. 3, extends through the second dielectric 212 from and through the second stop surface 214 to and through a lower face 218. The second through-passage 216 is aligned with the first through-passage 208. The first stop surface 206 and the second stop surface 214 define a gap 220 therebetween. The first dielectric 204 and the second dielectric 212 may be manufactured of any suitable material, such as the non-limiting examples of PTFE or Torlon (Polyimide-imide).

A contact pin 222 having a first pin section 224, a second pin section 226 and an annular collar 228 at a juncture 230 of the first pin section 224 and the second pin section 226 is shown. The first pin section 224 is movably disposed in the first through-passage 208 and the second pin section 226 is movably disposed in the second through-passage 216, with the annular collar 228 located in the gap 220. In this way, axial movement of the contact pin 222 is limited to movement of the annular collar 228 in the gap 220 between the first stop surface 206 and the second stop surface 214. Additionally, the first pin section 224 is adapted to provide electrical continuity with an external component, which may be a connector (not shown in FIGS. 3 and 4). The second pin section 226 may terminate distally in a connection feature 232.

With particular reference to FIG. 3, the annular collar 228 radially extends from the contact pin 222, so that an outside diameter "$A_{OD}$" of the annular collar 228 is greater than an inside diameter "$F_{ID}$" of the first through-passage 208 and an inside diameter "$S_{ID}$" of the second through-passage 216. A first side 234 of the annular collar 228 contacts the first stop surface 206 to limit the axial movement of the contact pin 222 in a first direction 238 to a first direction travel limit 239. A second side 236 of the annular collar 228 contacts the second stop surface 214 to limit the axial movement of the contact pin 222 in a second direction 240 to a second direction travel limit 241.

The connection feature 232 may be adapted for connection to the external structure 202, which, as mentioned above, may be a PCB 203. As such, the connection feature 232 may be soldered to the PCB 203, including to a conductive trace (not shown in FIGS. 3 and 4) of the PCB 203. With particular reference to FIG. 4, the RF connector pin assembly 200 may include a plurality of contact pins 222, wherein each contact pin 222 includes the first dielectric 204 and the second dielectric 212, as discussed above. In this regard, multiple connection features 232 from multiple contact pins 222 may engage the PCB 203. As described previously, the PCB 203 may not be perfectly flat or planar but instead may have surface non-uniformities, for example, a bow, as illustrated in FIG. 4. As the connection features 232 engage the PCB 203, the non-uniformity in the surface of the PCB 203 causes the connection features 232, and thereby, the respective contact pins 222, to axially move or "float". As a result, the annular collar 228 moves in the gap 220 between the first stop surface 206 and the second stop surface 214. This is illustrated in FIG. 4 by the annular collars 228 of the contact pins 222 being located in different portions of the respective gaps 220. Since the connection feature 232 is not used as a restraint, as discussed above with respect to the conventional floating pin assembly 100, there is no issue regarding a contact head being forced against a carrier or header and compromising the connection of the contact pin 222 to the PCB 203. The contact pin 222 may be manufactured of any suitable conductive material, such as the non-limiting example of brass plated gold over nickel.

Figure 5:
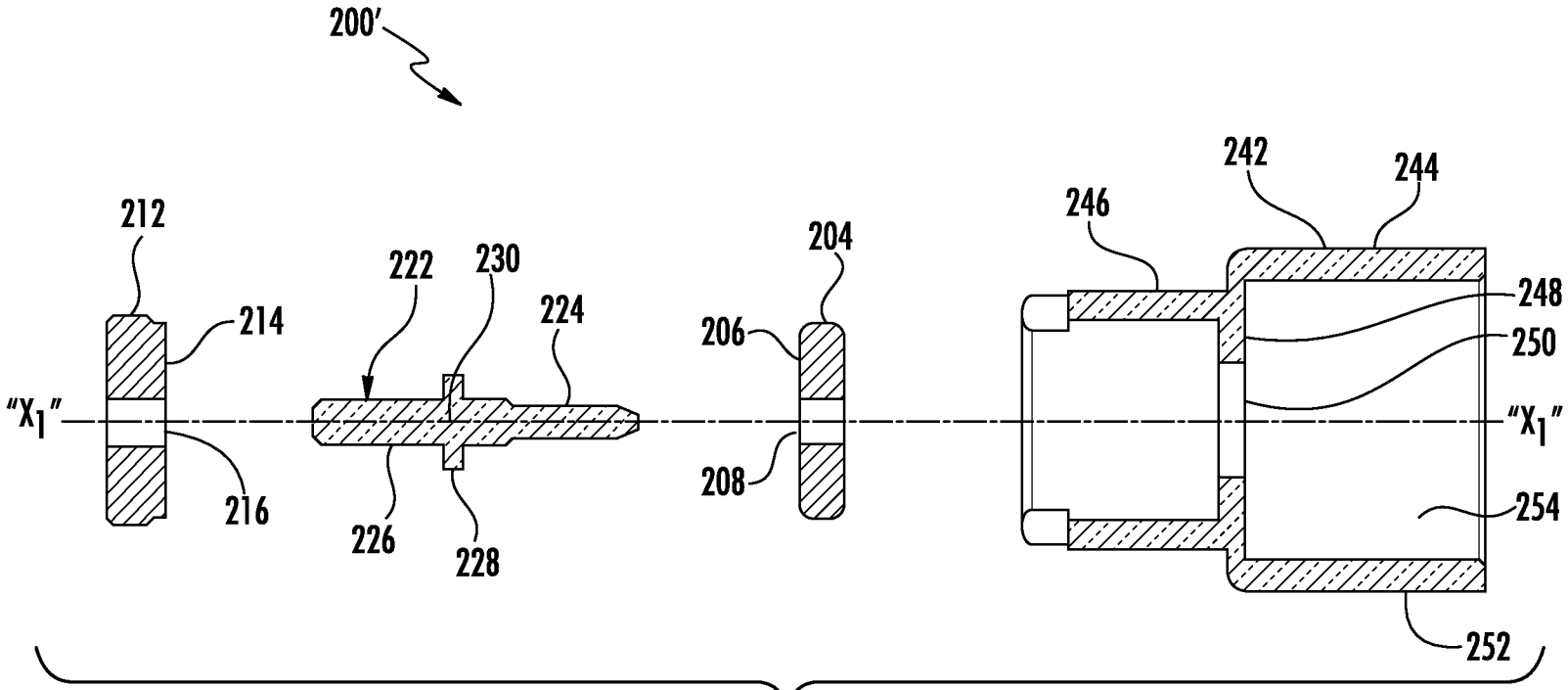
FIG. 5 is an exploded cross-sectional view of an exemplary embodiment of the RF connector pin assembly of FIG. 3 also having a housing.
Figure 6A:
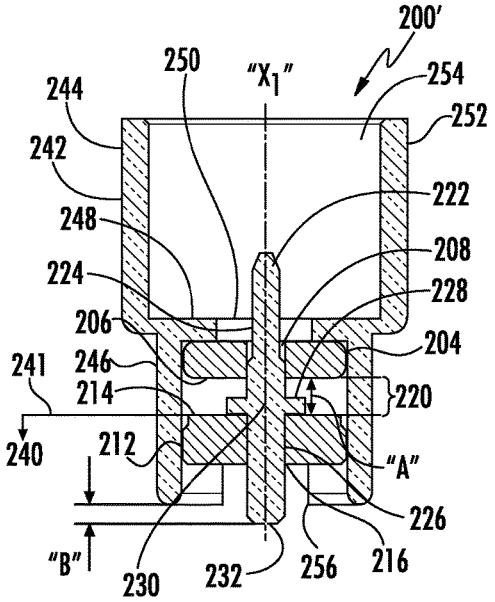
FIGS. 6A and 6B are detailed cross-sectional views of the assembled RF connector pin assembly of FIG. 5.
Figure 6B:
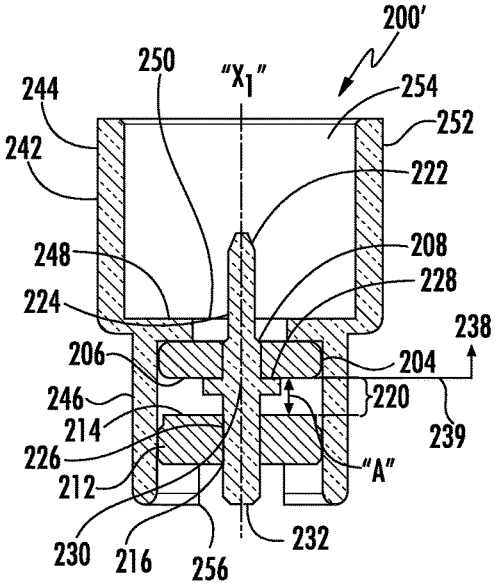
Figure 7:
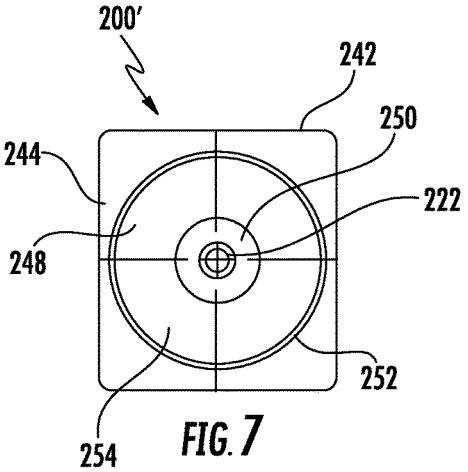
FIG. 7 is a top perspective view of the RF connector pin assembly of FIG. 5.

Referring now to FIGS. 5-7, an exemplary RF connector pin assembly 200' is illustrated. RF connector pin assembly 200' is the same as the RF connector pin assembly 200 discussed with respect to FIGS. 3 and 4, except with the addition of housing 242. FIG. 5 is an exploded cross-sectional view of the RF connector pin assembly 200' illustrating the housing 242, the first dielectric 204, the second dielectric 212, and the contact pin 222 aligned along the same axis "$X_1$". FIG. 6A is a detailed cross-sectional view of the assembled RF connector pin assembly 200' with the contact pin 222 at the second direction travel limit 241. FIG. 6B is a detailed cross-sectional view of the assembled RF connector pin assembly 200' with the contact pin 222 at the first direction travel limit 239. FIG. 7 is a top perspective view of the RF connector pin assembly 200'.

Continuing with reference to FIGS. 5, 6A and 6B, the housing 242 includes a first segment 244 and a second segment 246, with the second segment 246 separated from the first segment 244 by a partition 248. The partition 248 has an access opening 250 which extends between the first segment 244 and the second segment 246. The first dielectric 204 is positioned in the second segment 246. Similarly, the second dielectric 212 is positioned in the second segment 246. The first dielectric 204 and the second dielectric 212 may be positioned in the second segment 246 so that the first through-passage 208, the second through-passage 216 and the access opening 250 are aligned. The first stop surface 206 and the second stop surface 214 define the gap 220 between the first dielectric 204 and the second dielectric 212 with the first stop surface 206 spaced a distance "A" from the second stop surface 214 by the gap 220.

As discussed above, the contact pin 222 includes the first pin section 224, the second pin section 226 and the annular collar 228 at the juncture 230 of the first pin section 224 and the second pin section 226. The RF connector pin assembly 200' may be assembled by friction fitting the first dielectric 204 in the second segment 246; inserting the first pin section 224 in the first through-passage 208 of the first dielectric 204; and friction fitting the second dielectric 212 in the second segment 246 so that the second pin section 226 inserts in the second through-passage 216 of the second dielectric 212. In this way, the annular collar 228 does not have to be forced through either the first through-passage 208 or the second through-passage 216 to assemble the RF connector pin assembly 200'.

In this regard, the first pin section 224 is movably disposed in the first through-passage 208 and the second pin section 226 is movably disposed in the second through-passage 216, so that the contact pin 222 is axially movable in the first direction 238 and the second direction 240 in the first through-passage 208 and the second through-passage 216. Additionally, the first pin section 224 may extend through the first through-passage 208 and through the access opening 250 into the first segment 244. The first segment 244 may include a socket 252 with a receiving port 254 adapted to receive a connector (see, e.g., FIG. 12). The first pin section 224 may provide electrical continuity with the connector received by the receiving port 254 of the socket 252.

The second segment 246 includes an open distal end 256 opposite the partition 248. As shown in FIG. 6B, when axial movement of the contact pin 222 is at the first direction travel limit 239, the connection feature 232 may be in the housing 242. As shown in FIG. 6A, when axial movement of the contact pin 222 is at the second direction travel limit 241, the connection feature 232 may extend through the open distal end 256 of the housing 242 by a distance "B".

The distance "B" may not exceed the distance "A", which is the dimension of the gap 220. In this way, sufficient distance may be provided to allow the contact pin 222 to axially move in response to movement of the connection feature 232 by its engagement with the external structure 202, such as, for example, the PCB 203 (not shown). Moreover, the distance "B" may allow the housing 242 to contact the PCB 203, so that the housing 242 may be adapted to provide grounding continuity between the external component, for example, the connector received by the receiving port 254 of the socket 252 and the PCB 203. The housing 242 may be manufactured of any suitable material, such as the non-limiting example of brass plated gold over nickel.

FIG. 7 illustrates a top perspective view of the RF connector pin assembly 200' looking into the first segment 244 of the housing 242. The contact pin 222, partition 248 and access opening 250 are visible, as well as the socket 252 and receiving port 254. As will be discussed in more detail below, when the RF connector pin assembly 200' is installed, i.e., connected to a PCB 203, the top of the RF connector pin assembly 200' may be exposed and accessible to allow for connecting an external component, such as, for example, a connector.

Figure 8:
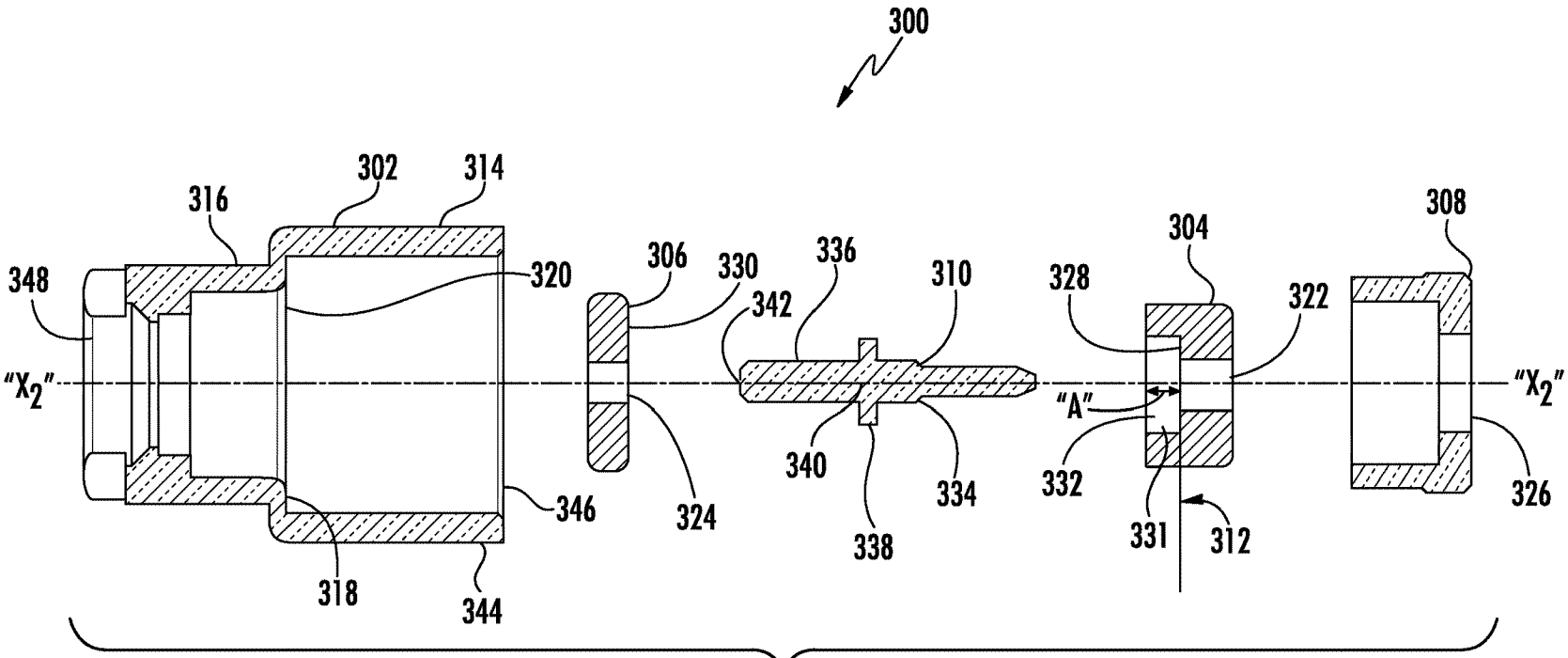
FIG. 8 is an exploded cross-sectional view of another exemplary embodiment of an RF connector pin assembly, having a connector pin, dielectrics and a housing.
Figure 9:
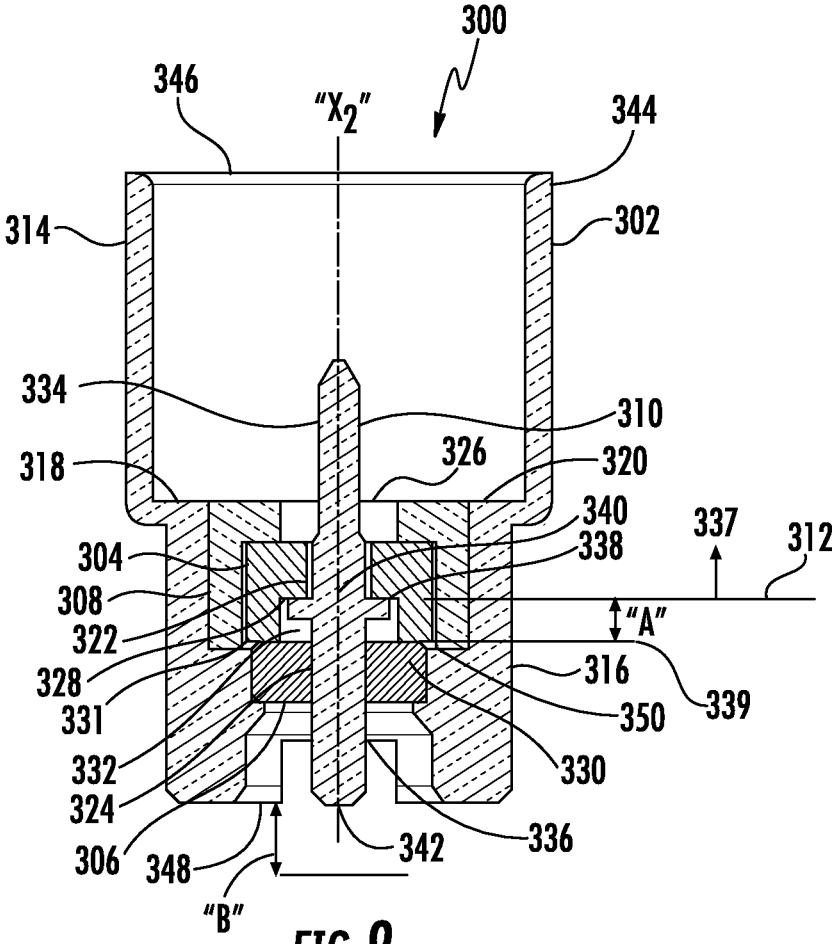
FIG. 9 is a detailed cross-sectional view of the assembled RF connector pin assembly of FIG. 8.
Figure 10:
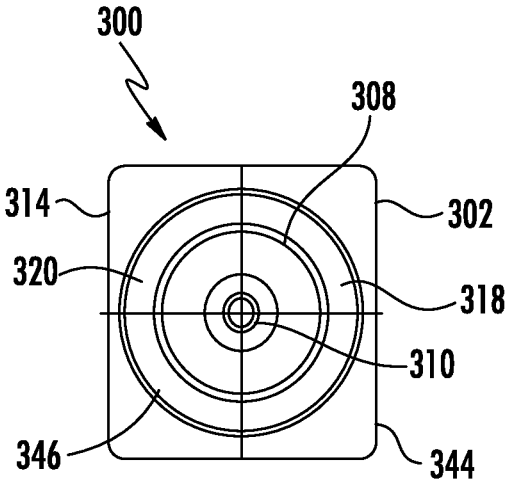
FIG. 10 is a top perspective view of the RF connector pin assembly of FIGS. 8 and 9.

Referring now to FIGS. 8-10, an exemplary RF connector pin assembly 300 is illustrated. RF connector pin assembly 300 includes certain aspects similar to those of RF connector pin assemblies 200 and 200' as discussed above with respect to FIGS. 3-7. Therefore, except for any substantive differences, the discussion of such similar aspects of the RF connector pin assemblies 200 and 200' will not be repeated here with respect to RF connector pin assembly 300.

FIG. 8 is an exploded cross-sectional view of the RF connector pin assembly 300 illustrating a housing 302, first dielectric 304, second dielectric 306, bushing 308 and contact pin 310 aligned along the same axis "$X_2$". FIG. 9 is a detailed cross-sectional view of the assembled RF connector pin assembly 300 with the contact pin 310 at a first direction travel limit 312. Continuing now with reference to FIGS. 8 and 9, the housing 302 includes a first segment 314 and a second segment 316, with the second segment 316 separated from the first segment 314 by a partition 318. An access opening 320 in the partition 318 extends between the first segment 314 and the second segment 316. The first dielectric 304, the second dielectric 306 and the bushing 308 are positioned in the second segment 316 so that a first through-passage 322 in the first dielectric 304, a second through-passage 324 in the second dielectric 306 and a bushing opening 326 in the bushing 308 are all aligned. The second segment 316 includes an open distal end 348 opposite the partition 318. A first stop surface 328 on the first dielectric 304 and a second stop surface 330 on the second dielectric 306 define a gap 332 with the first stop surface 328 spaced a distance "A" from the second stop surface 330 by the gap 332. Although a side 331 of the first dielectric 304 is shown abutting the second dielectric 306 in FIG. 9, the gap 332 remains formed between the first stop surface 328 and the second stop surface 330 bounded by the side 331. The first dielectric 304 and second dielectric 306 may be manufactured of any suitable material, such as the non-limiting examples of PTFE or Torlon (Polyimide-imide).

The contact pin 310 includes a first pin section 334, a second pin section 336 and an annular collar 338 at a juncture 340 of the first pin section 334 and the second pin section 336. The second pin section 336 may distally terminate in a connection feature 342. The RF connector pin assembly 300 may be assembled by friction fitting the second dielectric 306 in the second segment 316; inserting the second pin section 336 in the second through-passage 324 of the second dielectric 306; positioning the first dielectric 304 in the second segment 316 so that the first pin section 334 inserts in the first through-passage 322 of the first dielectric 304 and the annular collar 338 positions in the gap 332; and friction fitting the bushing 308 in the second segment 316 over the first dielectric 304 so that the first pin section 334 extends through the bushing opening 326. In this way, the annular collar 338 does not have to be forced through the first through-passage 322, the second through-passage 324 or the bushing opening 326 to assemble the RF connector pin assembly 300. The contact pin 310 and bushing 308 may be manufactured of any suitable material, such as the non-limiting example of brass plated gold over nickel.

In this regard, the first pin section 334 is movably disposed in the first through-passage 322 and the second pin section 336 is movably disposed in the second through-passage 324, so that the contact pin 310 may be axially movable in the first direction 337 and the second direction 339 in the first through-passage 322 and the second through-passage 324. Additionally, the first pin section 334 may extend through the first through-passage 322, the bushing opening 326 and through the access opening 320 into the first segment 314. The first segment 314 may include a socket 344 with a receiving port 346 adapted to receive a connector (see, e.g., FIG. 12). The first pin section 334 may provide electrical continuity with the connector received by the receiving port 346 of the socket 344.

The second segment 316 includes the open distal end 348 opposite the partition 318. In FIG. 9, the contact pin 310 is at the first direction travel limit 312 with the connection feature 342 positioned in the housing 302. In a similar manner to that of RF connector pin assembly 200', as shown in FIG. 6A, when axial movement of the contact pin 310 is at a second direction travel limit 350, the connection feature 342 may extend through the open distal end 348 of the housing 302 by the distance "B", which may be less than or equal to the distance "A", the dimension of the gap 332. In this way, sufficient distance may be provided to allow the contact pin 310 to axially move in response to movement of the connection feature 342 by its engagement with an external structure, such as, for example, a PCB. Moreover, the distance "B" may allow the housing 302 to contact the PCB, so that the housing 302 may be adapted to provide grounding continuity between the external component, for example, the connector received by the receiving port 346 of the socket 344 and the PCB. The housing 302 may be manufactured of any suitable material, such as the non-limiting example of brass plated gold over nickel.

FIG. 10 is a top perspective view of the RF connector pin assembly 300 looking into the first segment 314 of the housing 302. The contact pin 310, partition 318, bushing 308 and access opening 320 are visible, as well as the socket 344 and receiving port 346. As will be discussed in more detail below, the top of the RF connector pin assembly 300 may be exposed and accessible to allow for connecting an external component, such as, for example, a connector.

Figure 11B:
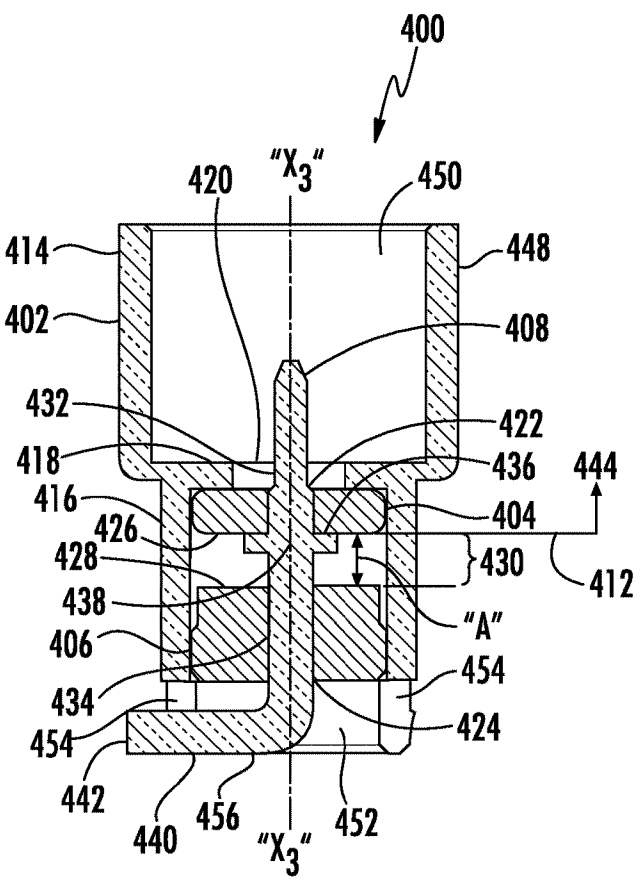
FIGS. 11A and 11B are detailed cross-sectional views of an exemplary embodiment of an assembled RF connector pin assembly, having a right-angle connector pin, dielectrics and a housing.
Figure 11A:
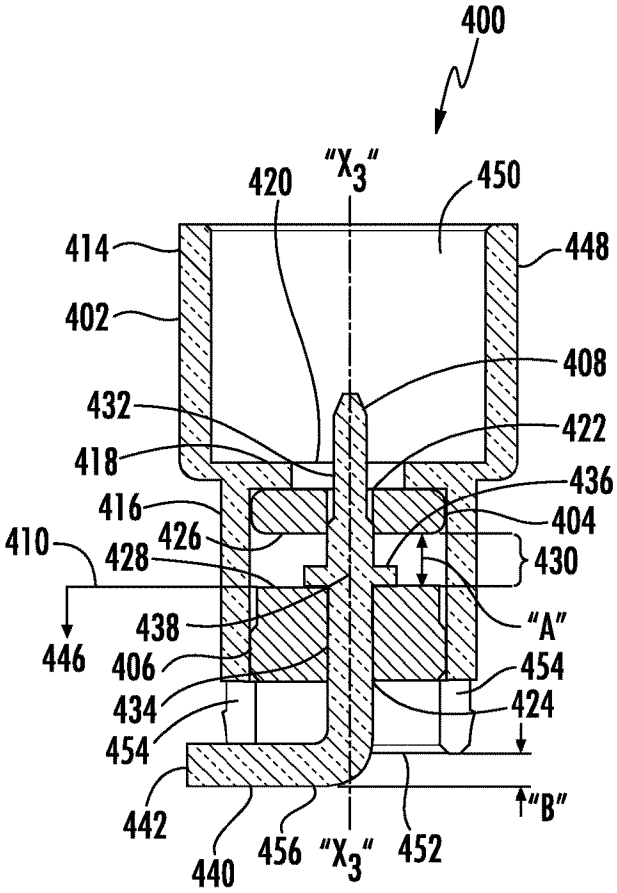

Referring now to FIGS. 11A and 11B, an exemplary RF connector pin assembly 400 is illustrated. RF connector pin assembly 400 includes certain aspects similar to those of RF connector pin assemblies 200, 200' as discussed above with respect to FIGS. 3-7. Therefore, except for any substantive differences, the discussion of such similar aspects of the RF connector pin assemblies 200, 200' will not be repeated here with respect to RF connector pin assembly 400.

FIGS. 11A and 11B are detailed cross-sectional views of the assembled RF connector pin assembly 400, illustrating a housing 402, first dielectric 404, second dielectric 406, and right-angle contact pin 408 (also referred to as a right-angle connector pin) aligned along the same axis "X3". FIG. 11A is a detailed cross-sectional view of the assembled RF connector pin assembly 400 with the right-angle contact pin 408 at a second direction travel limit 410. FIG. 11B is a detailed cross-sectional view of the assembled RF connector pin assembly 400 with the right-angle contact pin 408 at a first direction travel limit 412.

Continuing now with reference to FIGS. 11A and 11B, the housing 402 includes a first segment 414 and a second segment 416, with the second segment 416 separated from the first segment 414 by a partition 418. An access opening 420 in the partition 418 extends between the first segment 414 and the second segment 416. The first dielectric 404 is positioned in the second segment 416. Similarly, the second dielectric 406 is positioned in the second segment 416. The first dielectric 404 and the second dielectric 406 may be positioned in the second segment 416 so that a first through-passage 422 in the first dielectric 404, a second through-passage 424 and the access opening 420 are aligned. A first stop surface 426 and a second stop surface 428 define a gap 430 between the first dielectric 404 and the second dielectric 406 with the first stop surface 426 spaced a distance "A" from the second stop surface 428 by the gap 430. The first dielectric 404 and second dielectric 406 may be manufactured of any suitable material, such as the non-limiting examples of PTFE or Torlon (Polyimide-imide).

The right-angle contact pin 408 includes a first pin section 432, a second pin section 434, an annular collar 436 at a juncture 438 of the first pin section 432 and the second pin section 434, and a third pin section 440 extending from the second pin section 434 at an angle thereto. Specifically, the third pin section 440 is approximately perpendicular (i.e., at an approximate right angle) to the second pin section 434. The third pin section 440 is integrally connected to the second pin section 434. The third pin section 440 may distally terminate in a connection feature 442.

The RF connector pin assembly 400 may be assembled by friction fitting the first dielectric 404 in the second segment 416; inserting the third pin section 440 through the second through-passage 424 of the second dielectric 406; inserting the second pin section 434 in the second through-passage 424 of the second dielectric 406; and friction fitting the second dielectric 406 in the second segment 416 so that the first pin section 432 inserts in the first through-passage 422 of the first dielectric 404. In this way, the annular collar 436 does not have to be forced through either the first through-passage 422 or the second through-passage 424 to assemble the RF connector pin assembly 400. The right-angle contact pin 408 may be manufactured of any suitable material, such as the non-limiting example of brass plated gold over nickel.

In this regard, the first pin section 432 is movably disposed in the first through-passage 422 and the second pin section 434 is movably disposed in the second through-passage 424, so that the right-angle contact pin 408 may be axially movable in a first direction 444 and a second direction 446 in the first through-passage 422 and the second through-passage 424. Additionally, the first pin section 432 may extend through the first through-passage 422 and through the access opening 420 into the first segment 414. The first segment 414 may include a socket 448 with a receiving port 450 adapted to receive a connector (see, e.g., FIG. 12). The first pin section 432 may provide electrical continuity with the connector received by the receiving port 450 of the socket 448.

The second segment 416 includes an open distal end 452 opposite the partition 418. Further, the second segment 416 includes one or more sidewall channels 454 upwardly extending from the open distal end 452. In particular, the third pin section 440 is positioned through at least one of the one or more sidewall channels 454, with the connection feature 442 extending past the second segment 416 to an exterior of the housing 402. As shown in FIG. 11B, when axial movement of the right-angle contact pin 408 is at the first direction travel limit 412, the connection feature 442 is exterior to the housing 402, at least a portion of the third pin section 440 is positioned within the one or more sidewall channels 454, and at least a portion of a distal end 456 of the third pin section 440 may be in the housing 402. As shown in FIG. 11A, when axial movement of the right-angle contact pin 408 is at the second direction travel limit 410, the connection feature 442 remains exterior to the housing 402, the third pin section 440 is at least partially positioned within the one or more sidewall channels 454, and at least a portion of the distal end 456 of the third pin section 440 extends through the open distal end 452 of the housing 402 by a distance "B". The distance "B" may be less than or equal to the distance "A", which is the dimension of the gap 430. In this way, sufficient distance may be provided to allow the right-angle contact pin 408 to axially move in response to movement of the third pin section 440 (and connection feature 442) by its engagement with an external structure, such as, for example, a PCB 203 (see FIG. 4). Moreover, the distance "B" may allow the housing 402 to contact the PCB 203, so that the housing 402 may be adapted to provide grounding continuity between the external component, for example, the connector received by the receiving port 450 of the socket 448 and the PCB 203. The housing 402 may be manufactured of any suitable material, such as the non-limiting example of brass plated gold over nickel.

Figure 12:
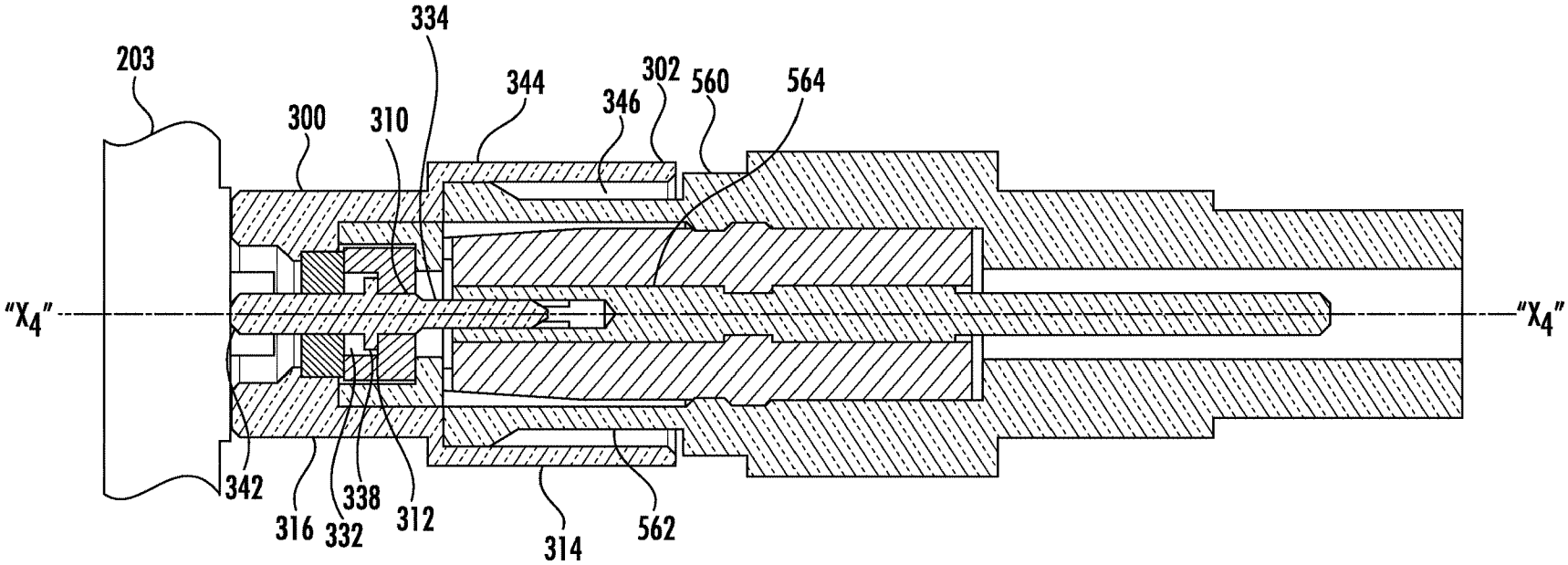
FIG. 12 is a cross-sectional view of the RF connector pin assembly of FIG. 8 connected to a printed circuit board (PCB) and with a connector attached.

FIG. 12 is a cross-sectional view of the RF connector pin assembly 300 connected to the PCB 203 and with a connector 560 inserted in the receiving port 346. The RF connector pin assembly 300 is aligned with connector 560 along the same axis "$X_4$". The second segment 316 of housing 302 contacts the PCB 203 and, thereby, establishes ground continuity with a body 562 of the connector 560 through the first segment 314 of the housing 302. The connection feature 342 of the contact pin 310 is shown connected to a conductor of the PCB 203, which may be accomplished by soldering the connection feature 342 to a conductive trace (not shown in FIG. 12) on the PCB 203. The annular collar 338 is shown located at the first direction travel limit 312 of the gap 332. The first pin section 334 is shown inserted in the connector 560 and providing continuity with an inner conductor 564 of the connector 560 to establish continuity from the PCB 203 through the contact pin 310 to the inner conductor 564.

Figure 13:
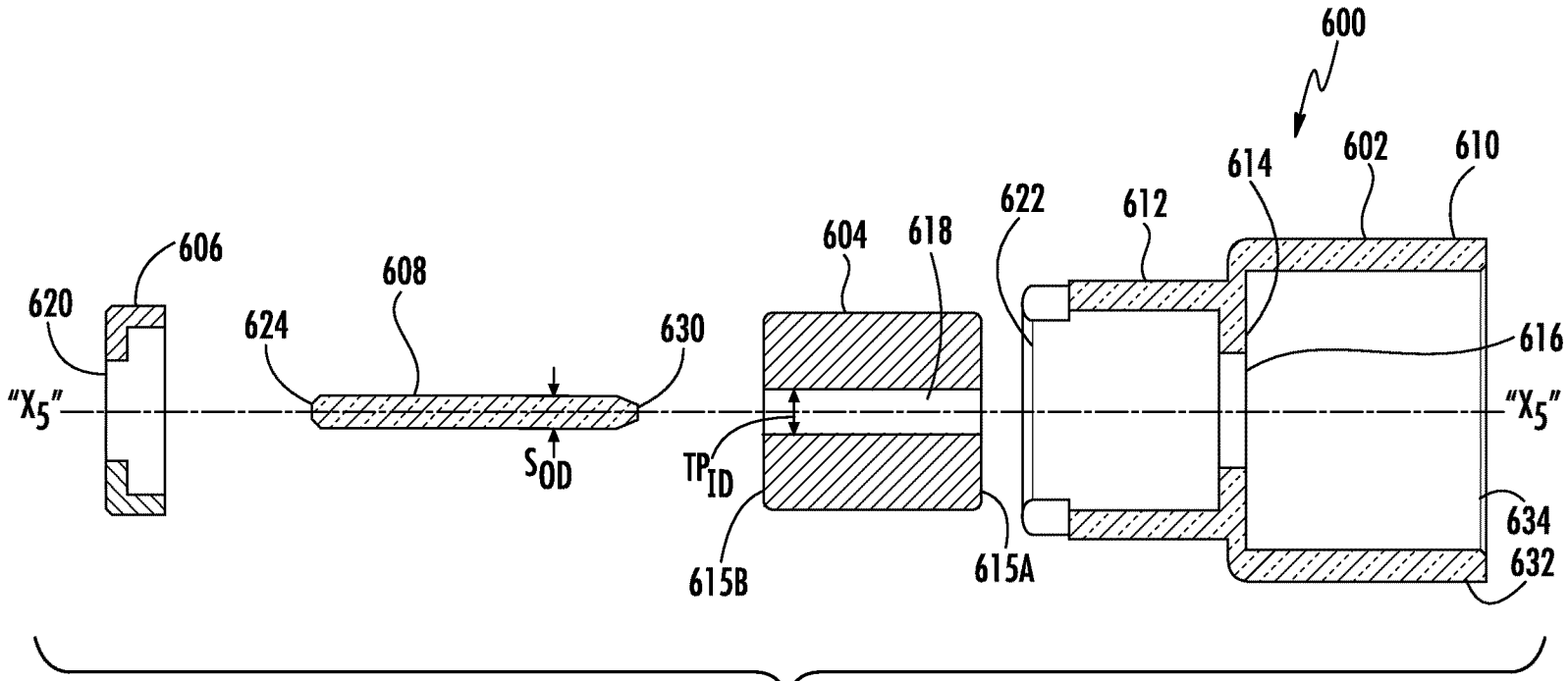
FIG. 13 is an exploded cross-sectional view of another exemplary embodiment of an RF connector pin assembly, having a connector pin, a dielectric and a housing.
Figure 14A:
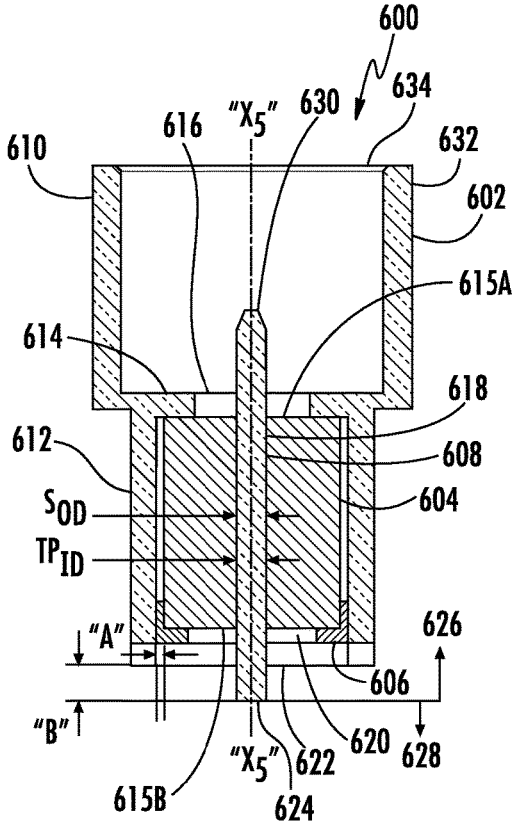
FIGS. 14A and 14B are detailed cross-sectional views of the assembled RF connector pin assembly of FIG. 13.
Figure 14B:
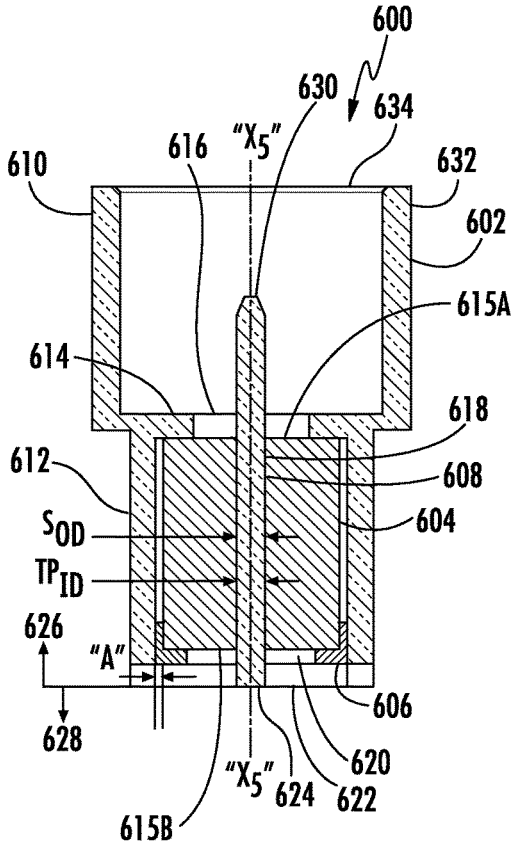

Referring now to FIGS. 13-14B, an exemplary RF connector pin assembly 600 is illustrated. RF connector pin assembly 600 includes certain aspects similar to those of RF connector pin assemblies 200, 200', 300, 400 of FIGS. 3-12. Therefore, except for any substantive differences, the discussion of such similar aspects of the RF connector pin assemblies 200, 200', 300, 400 will not be repeated here with respect to RF connector pin assembly 600.

FIG. 13 is an exploded cross-sectional view of the RF connector pin assembly 600 illustrating a housing 602, dielectric 604, bushing 606, and contact pin 608 aligned along the same axis "$X_5$" (also shown in FIGS. 14A-14B). FIG. 14A is a detailed cross-sectional view of the assembled RF connector pin assembly 600 with the contact pin 608 at a first position. FIG. 6B is a detailed cross-sectional view of the assembled RF connector pin assembly 600 with the contact pin 608 at a second position.

Continuing now with reference to FIGS. 13-14B, the housing 602 includes a first segment 610 and a second segment 612, with the second segment 612 separated from the first segment 610 by a partition 614. An access opening 616 in the partition 614 extends between the first segment 610 and the second segment 612. The dielectric 604 and the bushing 606 are positioned in the second segment 612 so that a through-passage 618 in the dielectric 604 and a bushing opening 620 in the bushing 606 are all aligned. The through-passage 618 includes an inside diameter $TP_{ID}$ and extends between a first face 615A and a second face 615B of the dielectric 604. The second segment 612 includes an open distal end 622 opposite the partition 614. The dielectric 604 may be manufactured of any suitable material, such as the non-limiting examples of PTFE or Torlon (Polyimide-imide).

The contact pin 608 (also referred to as a shaft) may distally terminate in a connection feature 624. The contact pin 608 includes a shaft outer diameter $S_{OD}$. The RF connector pin assembly 600 may be assembled by friction fitting the dielectric 604 with the bushing 606 (e.g., an outer surface of the dielectric 604 frictionally engages an inner surface of the bushing 606); friction fitting the bushing 606 in the second segment 612 (e.g., an outer surface of the bushing 606 frictionally engages an inner surface of the second segment 612) so that the dielectric 604 is inserted in the second segment 612; and friction fitting the contact pin 608 in the through-passage 618 of the dielectric 604 so that at least a portion of the contact pin 608 (and the connection feature 624) extends past the open distal end 622. In this way, the contact pin 608 does not have to be forced through the through-passage 618 to assemble the RF connector pin assembly 600. The contact pin 608 and bushing 606 may be manufactured of any suitable material, such as the non-limiting example of brass plated gold over nickel.

In this regard, when assembled, the bushing 606 mounts the dielectric 604 and contact pin 608 within the housing 602 and also provides a distance "A" between an outer surface of the dielectric 604 and an inner surface of the second segment 612 of the housing 602. The distance "A" reduces stress on the contact pin 608 during assembly of the dielectric 604 and contact pin 608 within the second segment 612 of the housing 602. Additionally, the dielectric 604 may expand due to heat when the RF connector pin assembly 600 is mounted to a PCB. The distance "A" allows for radial expansion of the dielectric 604, further reducing stress on the contact pin 608. Further, the distance "A" prevents axial expansion of the dielectric 604, which is important for maintaining reliability and electric performance characteristics, as electrical features of the RF connector pin assembly 600 may depend on the distance between the dielectric 604 and the open distal end 622 of the housing 602.

The contact pin 608 is movably disposed in the through-passage 618, so that the contact pin 608 may be axially movable in a first direction 626 and a second direction 628 in the through-passage 618. Additionally, a proximal end 630 of the contact pin 608 may extend past the through-passage 618 and through the access opening 616 into the first segment 610. The first segment 610 may include a socket 632 with a receiving port 634 adapted to receive a connector (see, e.g., FIG. 12). The contact pin 608 may provide electrical continuity with the connector received by the receiving port 634 of the socket 632.

In FIG. 14A, the contact pin 608 is at the first position with the connection feature 624 extending through the open distal end 622 of the housing 602 by the distance "B". In this way, sufficient distance may be provided to allow the contact pin 608 to axially move in response to movement of the connection feature 624 by its engagement with an external structure, such as, for example, a PCB. Moreover, the distance "B" may allow the housing 602 to contact the PCB, so that the housing 602 may be adapted to provide grounding continuity between the external component, for example, the connector received by the receiving port 634 of the socket 632 and the PCB. The housing 602 may be manufactured of any suitable material, such as the non-limiting example of brass plated gold over nickel.

The frictional engagement of the contact pin 608 with the dielectric 604 is enough that the contact pin 608 does not move in the first direction 626 as the RF connector pin assembly 600 engages or disengages a connector (see, e.g., FIG. 12). However, this frictional engagement may be purposefully or intentionally overcome to alter the position of the contact pin 608 relative to the dielectric 604 and the housing 602. In this way, the distance of the connection feature 624 of the contact pin 608 relative to the open distal end 622 of the housing 602 allows for intentional movement, but prevents accidental movement.

Figure 15A:
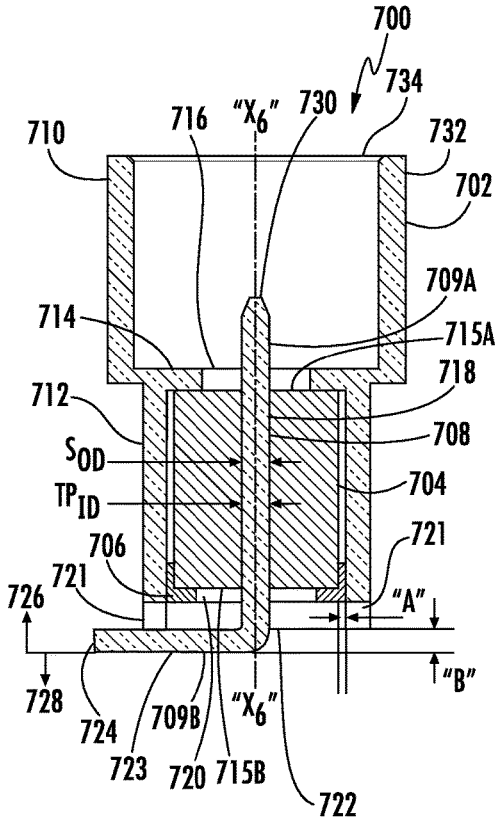
FIGS. 15A and 15B are detailed cross-sectional views of another exemplary embodiment of an assembled RF connector pin assembly, having a right-angle connector pin, a dielectric and a housing.
Figure 15B:
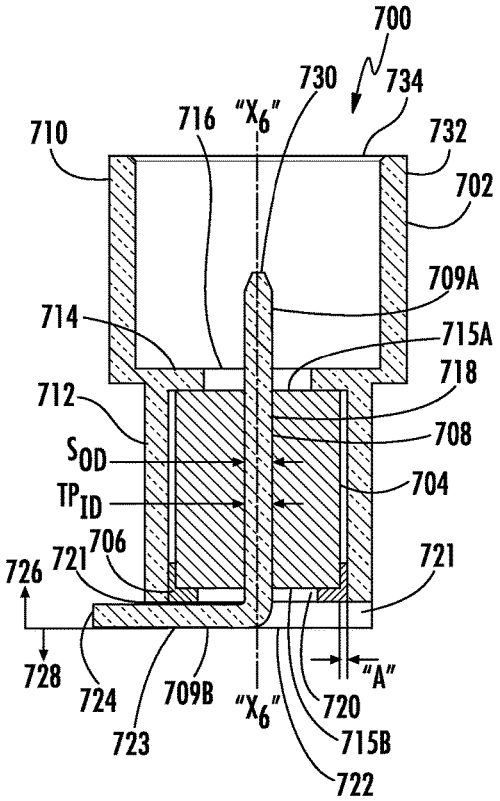

Referring now to FIGS. 15A and 15B, an exemplary RF connector pin assembly 700 is illustrated. RF connector pin assembly 700 includes certain aspects similar to those of RF connector pin assemblies 200, 200', 300, 400, 600 of FIGS. 3-14B. Therefore, except for any substantive differences, the discussion of such similar aspects of the RF connector pin assemblies 200, 200', 300, 400, 600 will not be repeated here with respect to RF connector pin assembly 700.

FIG. 15A is a detailed cross-sectional view of the assembled RF connector pin assembly 700 illustrating a housing 702, dielectric 704, bushing 706, and contact pin 708 aligned along the same axis "$X_6$" and with the contact pin 708 at a first position. FIG. 15B is a detailed cross-sectional view of the assembled RF connector pin assembly 700 with the contact pin 708 at a second position.

Continuing now with reference to FIGS. 15A-15B, the housing 702 includes a first segment 710 and a second segment 712, with the second segment 712 separated from the first segment 710 by a partition 714. An access opening 716 in the partition 714 extends between the first segment 710 and the second segment 712. The dielectric 704 and the bushing 706 are positioned in the second segment 712 so that a through-passage 718 in the dielectric 704 and a bushing opening 720 in the bushing 706 are all aligned. The through-passage 718 includes an inside diameter $TP_{ID}$ and extends between a first face 715A and a second face 715B of the dielectric 704. The second segment 712 includes an open distal end 722 opposite the partition 714. The dielectric 704 may be manufactured of any suitable material, such as the non-limiting examples of PTFE or Torlon (Polyimide-imide).

The contact pin 708 includes a first pin section 709A (also referred to as a shaft) and a second pin section 709B (also referred to as a shaft). Each of the first pin section 709A and the second pin section 709B include a shaft outer diameter $S_{OD}$. The second pin section 709B extends from the first pin section 709A at an angle thereto. Specifically, the second pin section 709B is approximately perpendicular (i.e., at an approximate right angle) to the first pin section 709A. The second pin section 709B is integrally connected to the first pin section 709A. The second pin section 709B may distally terminate in a connection feature 724.

The RF connector pin assembly 700 may be assembled by friction fitting the dielectric 704 with the bushing 706 (e.g., an outer surface of the dielectric 704 frictionally engages an inner surface of the bushing 706); friction fitting the bushing 706 in the second segment 712 (e.g., an outer surface of the bushing 706 frictionally engages an inner surface of the second segment 712) so that the dielectric 704 is inserted in the second segment 712; and friction fitting the first pin section 709A of the contact pin 708 in the through-passage 718 of the dielectric 704 so that at least a portion of the first pin section 709A of the contact pin 708 (and the connection feature 724) extends past the open distal end 722. In this way, the contact pin 708 does not have to be forced through the through-passage 718 to assemble the RF connector pin assembly 700. The contact pin 708 and bushing 706 may be manufactured of any suitable material, such as the non-limiting example of brass plated gold over nickel.

In this regard, when assembled, the bushing 706 mounts the dielectric 704 and contact pin 708 within the housing 702 and also provides a distance "A" between an outer surface of the dielectric 704 and an inner surface of the second segment 712 of the housing 702. The distance "A" reduces stress on the contact pin 708 during assembly of the dielectric 704 and contact pin 708 within the second segment 712 of the housing 702. Additionally, the dielectric 704 may expand due to heat when the RF connector pin assembly 700 is mounted to a PCB. The distance "A" allows for radial expansion of the dielectric 704, further reducing stress on the first pin section 709A of the contact pin 708. Further, the distance "A" prevents axial expansion of the dielectric 704, which is important for maintaining reliability and electric performance characteristics, as electrical features of the RF connector pin assembly 700 may depend on the distance between the dielectric 704 and the open distal end 722 of the housing 702.

The first pin section 709A of the contact pin 708 is movably disposed in the through-passage 718, so that the first pin section 709A of the contact pin 708 may be axially movable in a first direction 726 and a second direction 728 in the through-passage 718. Additionally, a proximal end 730 of the first pin section 709A of the contact pin 708 may extend past the through-passage 718 and through the access opening 716 into the first segment 710. The first segment 710 may include a socket 732 with a receiving port 734 adapted to receive a connector (see, e.g., FIG. 12). The first pin section 709A of the contact pin 708 may provide electrical continuity with the connector received by the receiving port 734 of the socket 732.

The second segment 712 includes the open distal end 722 opposite the partition 714. Further, the second segment 712 includes one or more sidewall channels 721 upwardly extending from the open distal end 722. In particular, the second pin section 709B is positioned through at least one of the one or more sidewall channels 721, with the connection feature 724 extending past the second segment 712 to an exterior of the housing 702.

In FIG. 15A, the contact pin 708 is at the first position with a distal end 723 of the second pin section 709B extending through the open distal end 722 of the housing 702 by the distance "B", and the connection feature 724 exterior to the housing 702. As shown in FIG. 15B, when axial movement of the contact pin 708 is moved in the first direction 726, the connection feature 724 remains exterior to the housing 702, and the second pin section 709B is at least partially positioned within the one or more sidewall channels 721. In this way, sufficient distance may be provided to allow the contact pin 708 to axially move in response to movement of the connection feature 724 by its engagement with an external structure, such as, for example, a PCB. Moreover, the distance "B" may allow the housing 702 to contact the PCB, so that the housing 702 may be adapted to provide grounding continuity between the external component, for example, the connector received by the receiving port 734 of the socket 732 and the PCB. The housing 702 may be manufactured of any suitable material, such as the non-limiting example of brass plated gold over nickel.

The frictional engagement of the contact pin 708 with the dielectric 704 is enough that the contact pin 708 does not move in the first direction 726 as the RF connector pin assembly 700 engages or disengages a connector (see, e.g., FIG. 12). However, this frictional engagement may be purposefully or intentionally overcome to alter the position of the contact pin 708 relative to the dielectric 704 and the housing 702. In this way, the distance of the connection feature 724 of the contact pin 708 relative to the open distal end 722 of the housing 702 allows for intentional movement, but prevents accidental movement.

Figure 16:
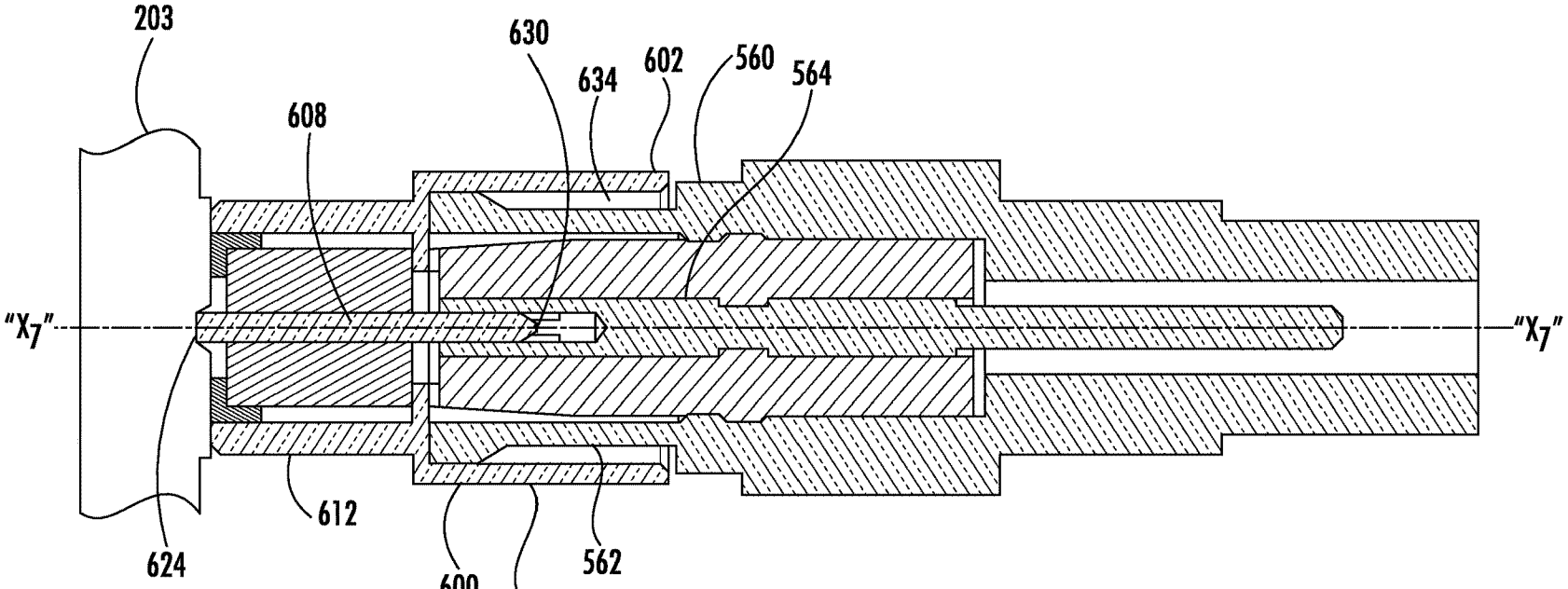
FIG. 16 is a cross-sectional view of the RF connector pin assembly of FIG. 13 connected to a PCB and with a connector attached.

FIG. 16 is a cross-sectional view of the RF connector pin assembly 600 connected to PCB 203 and with connector 560 inserted in the receiving port 634. The RF connector pin assembly 600 aligned with the connector 560 along the same axis "$X_7$". The second segment 612 of the housing 602 contacts the PCB 203 and thereby establishes ground continuity with the body 562 of the connector 560 through the first segment 610 of the housing 602. The connection feature 624 of the contact pin 608 is shown connected to a conductor of the PCB 203, which may be accomplished by soldering the connection feature 624 to a conductive trace (not shown in FIG. 16) on the PCB 203. The proximal end 630 of the contact pin 608 is inserted in the connector 560 and provides continuity with the inner conductor 564 of the connector 560 to establish continuity from the PCB 203 through the contact pin 608 to the inner conductor 564.

Figure 18:
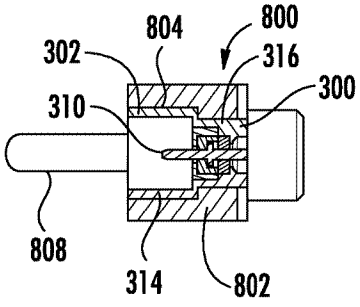
FIG. 18 is a cross-sectional view of the multi-pin RF connector block assembly of FIG. 17 cut along lines 18-18.
Figure 17:
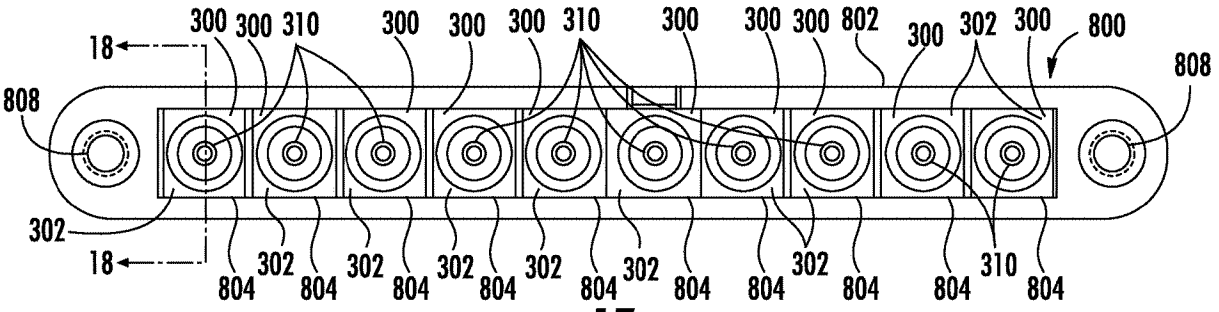
FIG. 17 is a top view of an exemplary embodiment of a multi-pin RF connector block assembly having multiple RF connector pin assemblies disposed therein.
Figure 19:
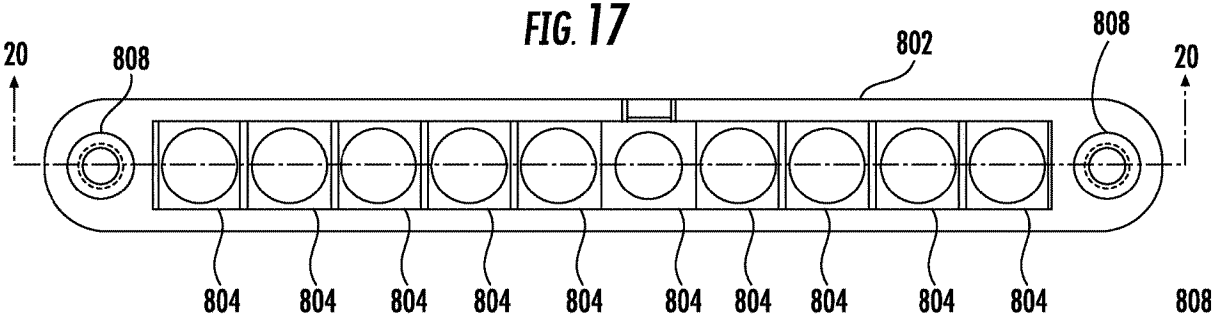
FIG. 19 is a top view of the connector block assembly of FIG. 17 without the RF connector pin assemblies.
Figure 20:
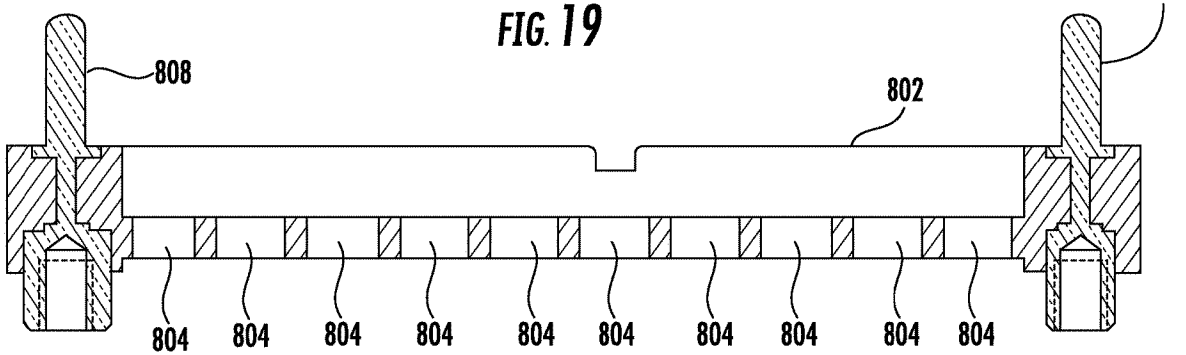
FIG. 20 is a cross-sectional view of the connector block assembly of FIG. 19 cut along lines 20-20.
Figure 21:
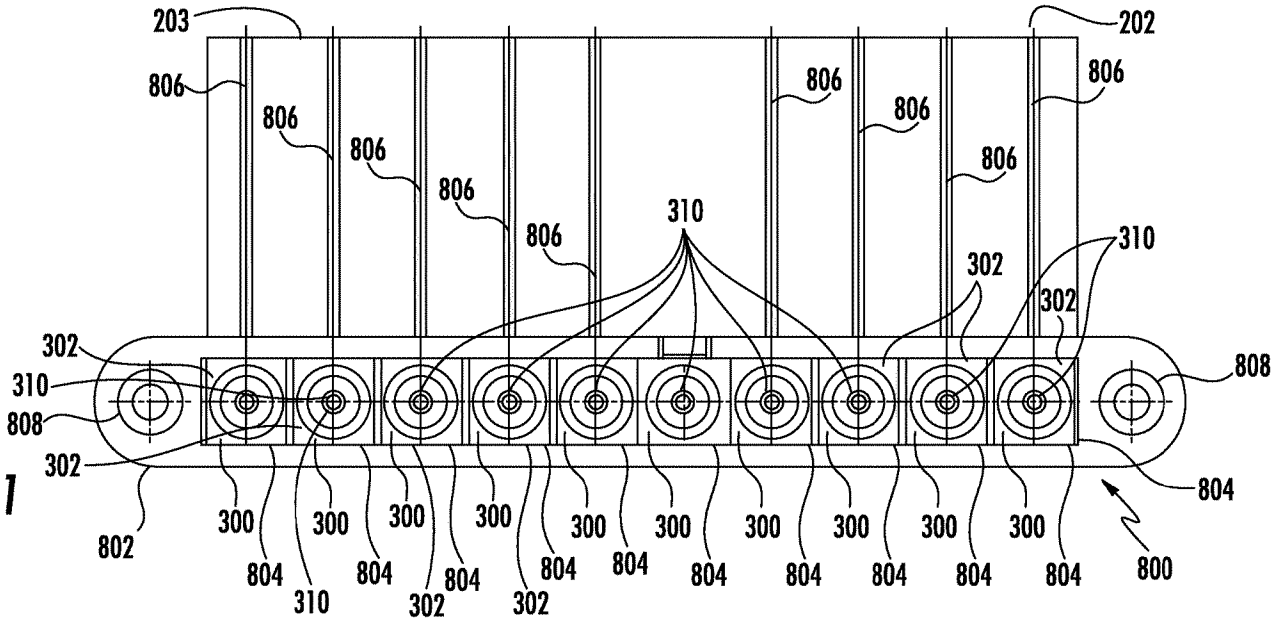
FIG. 21 is a top view of the multi-pin RF connector block assembly of FIG. 17 connected to a PCB.
Figure 22:
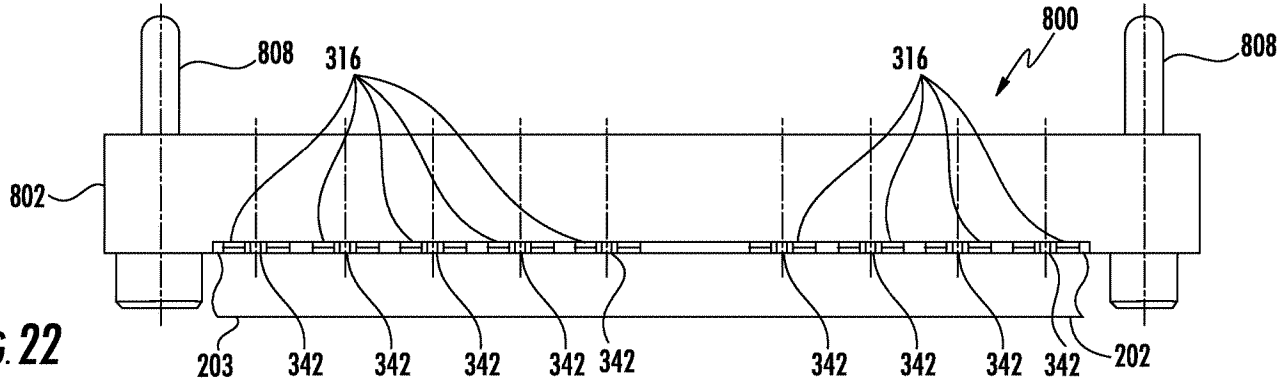
FIG. 22 is a side view of the multi-pin RF connector block assembly of FIG. 21.

FIGS. 17-22 are views of a multi-pin RF connector block assembly 800. RF connector block assembly 800 includes a plurality of RF connector pin assemblies 300 (see FIGS. 8 and 9) removably mounted in a connector block 802. FIG. 17 is a top view of the multi-pin RF connector block assembly 800 having multiple RF connector pin assemblies 300 disposed therein. FIG. 18 is a cross-sectional view of the connector block 802 with the connector pin assemblies 300 disposed therein. FIG. 19 is a top view of the connector block 802 without the RF connector pin assemblies 300. FIG. 20 is a cross-sectional view of the connector block 802 without the RF connector pin assemblies 300. FIG. 21 is a top view of the multi-pin RF connector block assembly 800 connected to a PCB 203. FIG. 22 is a side view of the multi-pin RF connector block assembly 800 connected to the PCB 203.

Each of the RF connector pin assemblies 300 removably mount in the connector block 802 by removably mounting a plurality of the housings 302 in respective housing ports of a plurality of housing ports 804. It should be noted that although FIGS. 17-22 illustrate RF connector pin assemblies 300, RF connector pin assemblies 200, 200', 400, 600, 700 may also be removably mounted in connector block 802, and the discussion of FIGS. 17-22 also applies to RF connector pin assemblies 200, 200', 400, 600, 700. As can be seen in FIGS. 21 and 22, connector block 802 mounts to the external structure 202, for example, the PCB 203. The housings 302 removably mount in the housing ports 804 so that the second segment 316 of housing 302 contacts the PCB 203 and thereby establishes ground continuity with the body 562 of the connector 560 (see, e.g. FIG. 12) through the first segment 314 of the housing 302. In this manner, one of the housings 302 is independently removably mounted from another one of the housings 302. Additionally, the contact pin 310 in one of the housings 302 is independently axially movable in a first direction 337 and a second direction 339 (see FIG. 9) from the contact pin 310 in another one of the housings 302. The connection feature 342 (shown in FIG. 22) of each contact pin 310 is connected to a conductive trace 806 (shown in FIG. 21) of the PCB 203, which may be accomplished by soldering the connection feature 342 to the conductive trace 806. Moreover, each of the second segments 316 (shown in FIG. 22) of housings 302 contact the PCB 203 and thereby establish ground continuity between the housings 302 and the PCB 203. In this manner, RF connector pin assembly 300 may include a plurality of housings 302 and a plurality of contact pins 310 connected to the PCB 203 using connector block 802. The connector block 802 may be manufactured of any suitable plastic material and may be mounted to the external structure 202 using any suitable fastener 808.

Figure 23:
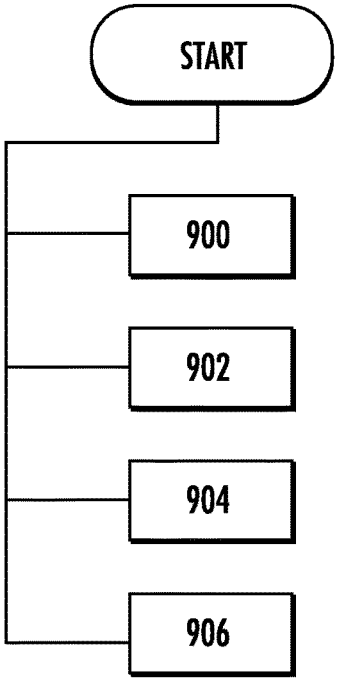
FIG. 23 is a flowchart diagram illustrating an exemplary process for assembling an RF connector pin assembly.

FIG. 23 depicts a method for assembling an RF connector pin assembly 200, 200', 300, 400, the method comprising providing a housing 242, 302, 402 comprising a first segment 244, 314, 414, a second segment 246, 316, 416 and a partition 248, 318, 418 separating the first segment 244, 314, 414, from the second segment 246, 316, 416 (block 900); inserting a first dielectric 204, 304, 404 in the second segment 246, 316, 416 of the housing 242, 302, 402, the first dielectric 204, 304, 404 comprising a first through-passage 208, 322, 422 and a first stop surface 206, 328, 426 (block 902); inserting a second dielectric 212, 306, 406 in the second segment 246, 316, 416 of the housing 242, 302, 402, the second dielectric 212, 306, 406 comprising a second through-passage 216, 324, 424 and a second stop surface 214, 330, 428 wherein the second through-passage 216, 324, 424 is aligned with the first through-passage 208, 322, 422 and wherein the first stop surface 206, 328, 426 and the second stop surface 214, 330, 428 form a gap 220, 332, 430 (block 904); movably positioning a contact pin 222, 310, 408 in the housing 242, 302, 402, the contact pin 222, 310, 408 comprising a first pin section 224, 334, 432, a second pin section 226, 336, 434 and an annular collar 228, 338, 436 at a juncture 230, 340, 438 of the first pin section 224, 334, 432 and the second pin section 226, 336, 434, wherein the first pin section 224, 334, 432 is movably disposed in the first through-passage 208, 322, 422 and the second pin section 226, 336, 434 is movably disposed in the second through-passage 216, 324, 424 and wherein the contact pin 222, 310, 408 is axially movable in a first direction 238, 337, 444 and a second direction 240, 339, 446 in the first through-passage 208, 322, 422 and the second through-passage 216, 324, 424, and wherein the annular collar 228, 338, 436 locates in the gap 220, 332, 430 other than by passing through the first through-passage 208, 322, 422 and the second through-passage 216, 324, 424 (block 906).

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A radio frequency (RF) connector block assembly, comprising:

a multi-connector block comprising a plurality of housing ports, wherein the multi-connector block is attachable to an external structure;

a plurality of housings, wherein each of the plurality of housings is removably mounted in one of the plurality of housing ports, and wherein a housing of the plurality of housings is independently removably mounted from another housing of the plurality of housings;

a contact pin movably disposed in each of the plurality of housings, wherein the contact pin in a housing of the plurality of housings is independently axially movable in a first direction and a second direction from the contact pin in another housing of the plurality of housings; and a first dielectric positioned in each of the plurality of housings, the first dielectric comprising a first through-passage extended through the first dielectric.

2. The RF connector block assembly of claim 1, wherein the contact pin comprises a first pin section adapted to be electrically continuous with an external component, and a second pin section distally terminated in a connection feature.

3. The RF connector block assembly of claim 2, wherein when the contact pin is extended at a second direction travel limit, the connection feature is extended through an open distal end of the plurality of housings.

4. The RF connector block assembly of claim 3, wherein the connection feature is extended out of the multi-connector block when extended through the open distal end of the plurality of housings.

5. The RF connector block assembly of claim 2, wherein the contact pin moves axially in response to movement of the connection feature by engagement with the external structure.

6. The RF connector block assembly of claim 2, wherein the external structure is a printed circuit board (PCB).

7. The RF connector block assembly of claim 6, wherein the connection feature is adapted for connection to the PCB.

8. The RF connector block assembly of claim 7, wherein the connection feature is adapted to be soldered to the PCB.

9. The RF connector block assembly of claim 8, wherein the connection feature is adapted to be soldered to a conductive trace of the PCB.

10. The RF connector block assembly of claim 1, further comprising a second dielectric positioned in each of the plurality of housings, the second dielectric comprising a second through-passage extended through the second dielectric, wherein the second through-passage is aligned with the first through-passage, and wherein the first dielectric and the second dielectric define a gap therebetween.

11. The RF connector block assembly of claim 10, wherein the contact pin comprises an annular collar movably disposed within the gap.

12. The RF connector block assembly of claim 11, wherein the annular collar radially extends from the contact pin, and wherein an outside diameter "$A_{OD}$" of the annular collar is greater than an inside diameter "$F_{ID}$" of the first through-passage and an inside diameter "$S_{ID}$" of the second through-passage.

13. The RF connector block assembly of claim 1, wherein the contact pin comprises a first pin section and a second pin section, wherein a portion of the second pin section is extended at an angle to the first pin section.

14. The RF connector block assembly of claim 13, wherein the second pin section is extended at a right angle to the first pin section.

15. The RF connector block assembly of claim 13, wherein each housing of the plurality of housings comprises a first segment and a second segment separated from the first segment by a partition, wherein the partition comprises an access opening extended between the first segment and the second segment.

16. The RF connector block assembly of claim 15, wherein the first segment comprises a socket with a receiving port adapted to receive a connector.

17. The RF connector block assembly of claim 16, wherein the first pin section is electrically continuous with the connector received by the receiving port of the socket.

18. The RF connector block assembly of claim 15, wherein the second segment comprises an open distal end opposite the partition.

19. The RF connector block assembly of claim 1, wherein each housing of the plurality of housings is adapted to provide grounding continuity with the external structure.

* * * * *